US005610693A

United States Patent [19]

Sugiyama et al.

[11] Patent Number: 5,610,693

[45] Date of Patent: Mar. 11, 1997

[54] DEVELOPING DEVICE FOR AN IMAGE FORMING APPARATUS

[75] Inventors: Toshihiro Sugiyama, Atsugi; Kazuhiro Yuasa, Zama; Shuichi Endoh, Isehara; Iwao Matsumae, Tokyo; Yoshiaki Tanaka, Kawasaki; Hiroshi Hosokawa, Yokohama; Mugijiroh Uno, Isehara; Hiroshi Saitoh, Ayase; Eiji Takenaka, Isehara; Tetsuo Yamanaka, Tokyo; Eisaku Murakami, Hiratsuka; Satoru Komatsubara, Atsugi, all of Japan

[73] Assignee: Ricoh Company, Ltd., Tokyo, Japan

[21] Appl. No.: 330,868

[22] Filed: Oct. 28, 1994

[30] Foreign Application Priority Data

Oct. 29, 1993 [JP] Japan ..... 5-272311

[51] Int. Cl.[6] ..... G03G 15/08

[52] U.S. Cl. ..... 399/272; 399/274

[58] Field of Search ..... 355/253, 259, 355/245, 251, 252; 118/657–658, 656

[56] References Cited

U.S. PATENT DOCUMENTS

| | | | |
|---|---|---|---|
| 4,378,158 | 3/1983 | Kanbe . | |
| 4,408,862 | 10/1983 | Takano et al. . | |
| 4,445,771 | 5/1984 | Sakamoto et al. . | |
| 4,480,911 | 11/1984 | Itaya et al. . | |
| 4,576,463 | 3/1986 | Sakamoto et al. . | |
| 4,637,708 | 1/1987 | Yuasa . | |
| 4,757,332 | 7/1988 | Yuasa . | |
| 4,788,570 | 11/1988 | Ogata et al. . | |
| 4,809,034 | 2/1989 | Murasaki et al. . | |
| 4,836,135 | 6/1989 | Kohyama et al. . | |
| 4,873,940 | 10/1989 | Ishikawa et al. . | |
| 4,912,513 | 3/1990 | Oka et al. | 355/253 |
| 5,003,917 | 4/1991 | Toyoshi et al. | 118/653 |
| 5,095,850 | 3/1992 | Komuro | 118/657 |

FOREIGN PATENT DOCUMENTS

| | | |
|---|---|---|
| 0572997A2 | 12/1993 | European Pat. Off. . |
| 4342060A1 | 6/1994 | Germany . |
| 2263789 | 8/1993 | United Kingdom . |

*Primary Examiner*—R. L. Moses

*Attorney, Agent, or Firm*—Oblon, Spivak, McClelland, Maier & Neustadt, P.C.

[57] ABSTRACT

In an image forming apparatus, a developing device of the type developing an electrostatic latent image formed on an image carrier by using single-component type toner has a regulating member for regulating the amount of the toner fed thereto, a first conveying member for conveying the toner regulated by the regulating member and deposited thereon, and a second conveying member for conveying the toner transferred from the first conveying member thereto to the image carrier. The first and second conveying members are each movable at a particular speed in a particular direction. The device is free from problems attributable to oppositely charged toner particles despite the use of the single-component type toner and, in addition, insures attractive images.

35 Claims, 7 Drawing Sheets

DEVELOPING DEVICE FOR AN IMAGE FORMING APPARATUS

BACKGROUND OF THE INVENTION

The present invention relates to a developing device for a facsimile apparatus, copier, printer or similar image forming apparatus.

It has been customary with an image forming apparatus to use a developing device operable with a single-component type developer, or toner, as distinguished from a two-component type toner made tip of toner and carrier. With this type of developer, or toner as referred to hereinafter, it is possible to reduce the overall size of the developing device and to, in principle, eliminate the need for maintenance. However, such toner suffers from a lack of reliability. Moreover, charging this kind of toner uniformly is so difficult, toner particles charged to polarity opposite to desired polarity are not avoidable. The oppositely charged particles would deposit on and contaminate the background of an image.

The prerequisite with the developing device is that a toner layer be formed on a developing roller or similar developer carrier by uniformly charged toner particles. However, to insure uniform charging, the amount of toner to deposit on the developer carrier should not be excessively great. Furthermore, when the ratio of the liner velocity of the developer carrier to that of a photoconductive element or similar image carrier is excessively great, an excessive scavenging force will act on the toner. At the same time, the toner will be frictionally charged by the image carrier to bring about various problems known in the art.

Whether the toner be charged by friction by a regulating member and first conveying means or by charge injection, the amount of toner to be uniformly charged (i.e., the amount of toner to deposit on the unit area of the first conveying means) should be limited; otherwise, the proportion of oppositely charged toner particles would increase. Therefore, to effect uniform charging, it is not always practicable to deposit the same amount of toner on the first conveying means as needed on the image carrier.

Therefore, the state-of-the-art developing device has to be designed in such a manner as to balance the amount of toner on the developer carrier and the linear velocity ratio of the developer carrier to the image carrier. As a result, the conventional developing device is not always capable of producing attractive images.

SUMMARY OF THE INVENTION

It is, therefore, an object of the present invention to provide an image forming apparatus capable of eliminating, despite the use of toner alone, the problems attributable to oppositely charged toner particles and, in addition, capable of producing attractive images.

In an image forming apparatus, a developing device of the type developing an electrostatic latent image formed on an image carrier by using single-component type toner of the present invention has a regulating member for regulating the amount of the toner fed thereto, a first conveying member for conveying the toner regulated by the regulating member and deposited thereon, and a second conveying member for conveying the toner transferred from the first conveying member thereto to the image carrier. The first and second conveying members are each movable at a particular speed in a particular direction.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
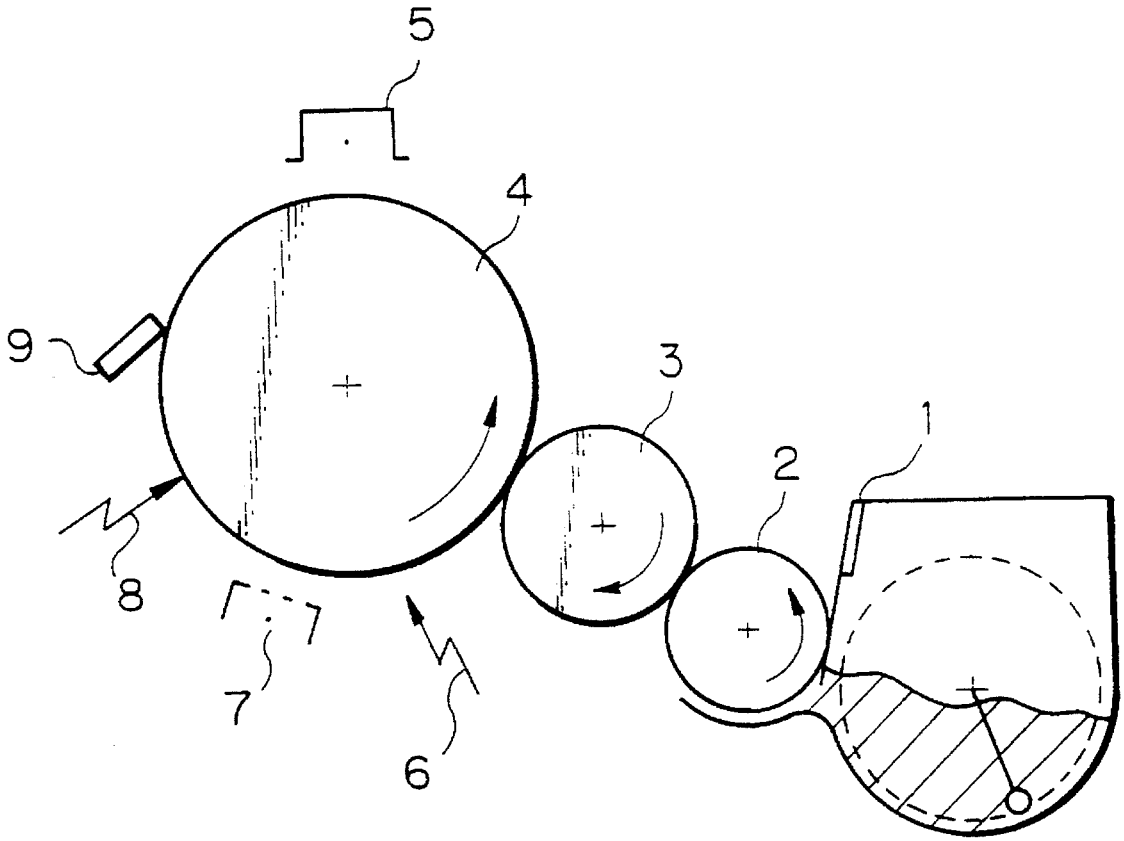
FIG. 1 schematically shows an image forming apparatus incorporating a developing device embodying the present invention and using nonmagnetic toner.

Referring to FIGS. 1–5, an image forming apparatus having a developing device embodying the present invention is shown. To begin with, a reference will be made to FIGS. 1 and 2 for describing the embodiment implemented with nonmagnetic single-component type toner. As shown in FIG. 1, the image forming apparatus has a blade, or regulating member 1, for regulating the toner fed from a toner supply section, a first and a second conveyor roller, or conveying means, 2 and 3 for conveying the toner, and an image carrier in the form of a drum 4. The toner is deposited on the first conveying means 2 while being regulated in amount by the regulating member 1. Then, the toner is transferred from the first conveying means 2 to the second conveying means 3. Finally, the toner is transferred from the second conveying means 3 to the image carrier 4 to develop a latent image electrostatically formed on the image carrier 4. There are also shown in the figure an image transfer unit 5, a laser beam 6 for writing an image on the image carrier 4, a charger 7, light 8 for discharging the image carrier 4, and a cleaning unit 9.

Figure 2:
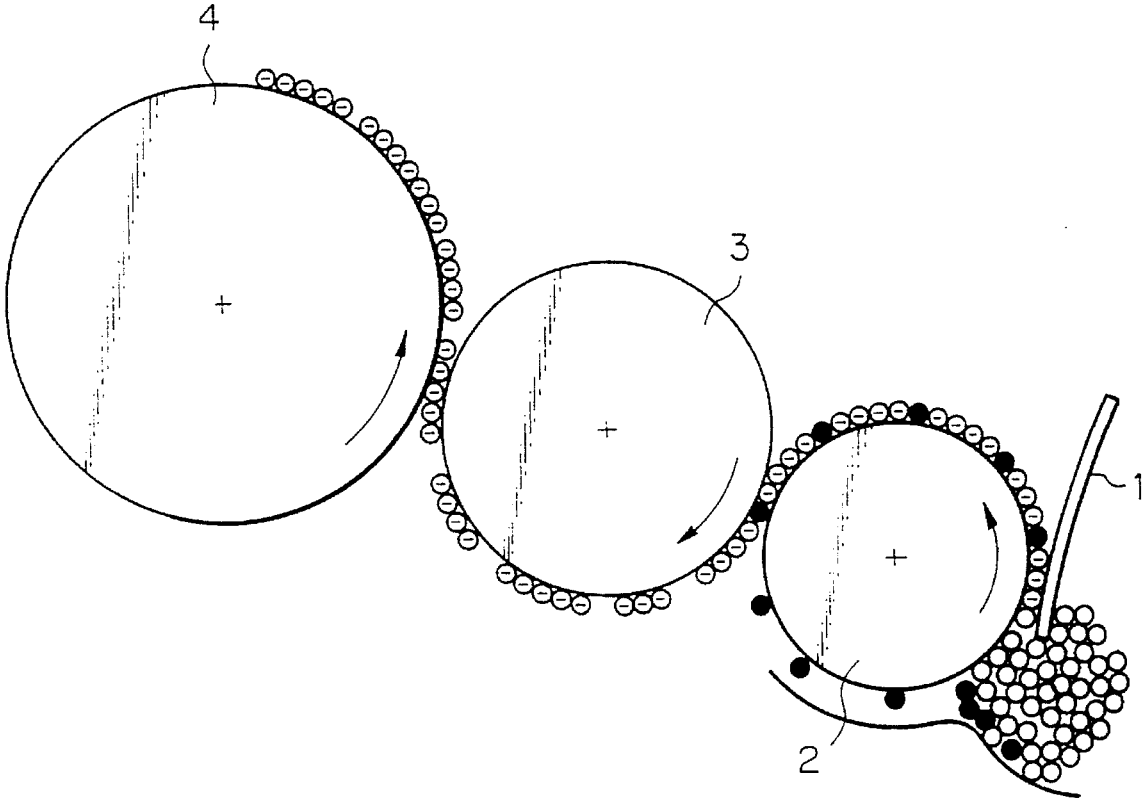
FIG. 2 is a schematic view modeling the transfer of the toner.
Figure 3:
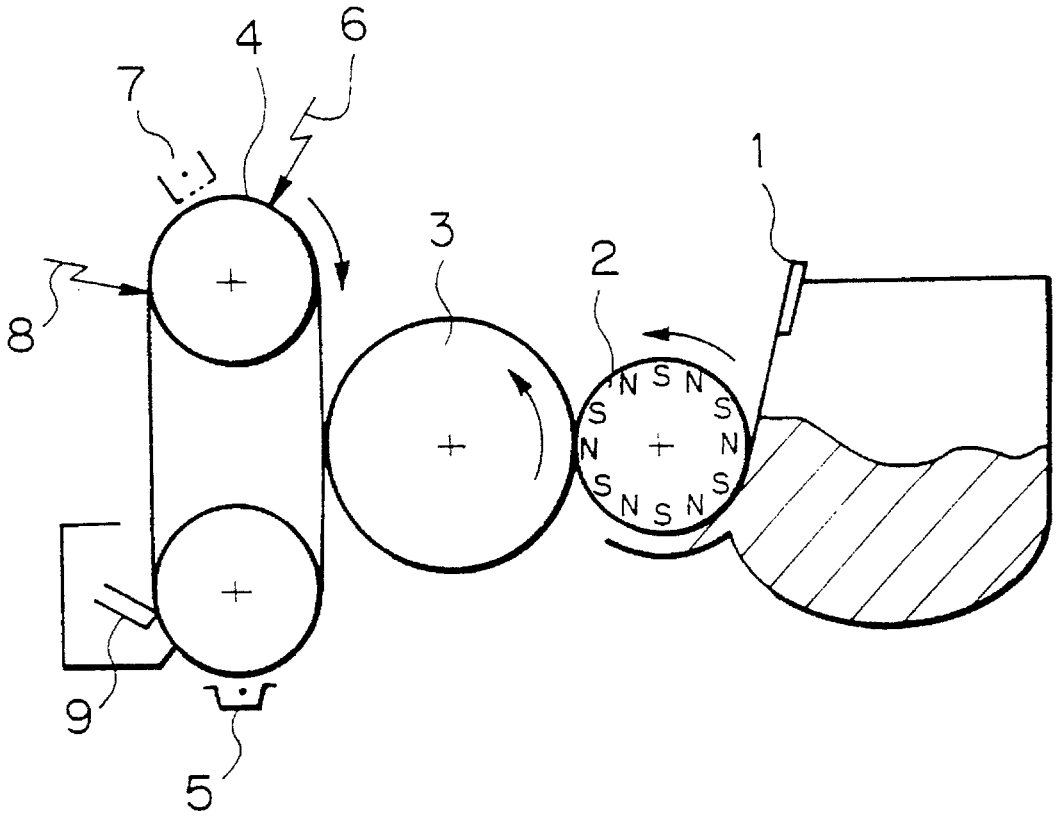
FIG. 3 schematically shows the embodiment using magnetic toner in place of the nonmagnetic toner.

The toner transfer to occur in the image forming apparatus will be described with reference to FIG. 2 specifically. As shown, the regulating member 1 regulates the amount of toner while frictionally charging the toner in cooperation with the first conveying means 2. The toner particles charged by friction are transferred from the first conveying means to the second conveying means 3 due to the force of an electric field. At this instant, some toner particles are charged to the opposite polarity while some are left uncharged, as indicated by dots in the figure. However, such undesirable toner particles are not transferred from the conveying means 2 to the conveying means 3 since the electric field acts thereon in the opposite direction. As a result, only the toner particles charged to the expected polarity, as represented by circles, are transferred to the conveying means 2 and form a layer thereon. Hence, when the toner is transferred from the conveying means 2 to the image carrier 4 by an electric field generated therebetween, it is prevented from depositing on the background of the image carrier As shown in FIG. 3, the developing device may be implemented by magnetic type toner as distinguished from the nonmagnetic toner described above. In FIG. 3, the same or similar constituent parts as or to the parts shown in FIG. 1 are designated by the same reference numerals, and a detailed description thereof will not be made in order to avoid redundancy. As shown, the image carrier 4 is implemented as a belt. The first conveying means 2 is provided with a layer for generating an electric field. The developing device using magnetic toner is similar in operation and effect to the developing device using nonmagnetic toner.

Generally, whether the toner be charged by friction by the regulating member 1 and first conveying means 2 or by charge injection, the amount of toner to be uniformly charged (i.e., the amount of toner to deposit on the unit area of the conveying means 2) should be limited; otherwise, the proportion of oppositely charged toner particles would increase. Therefore, to effect uniform charging, it is not always practicable to deposit the same amount of toner on the conveying means 2 as needed on the image carrier 4.

Figure 4:
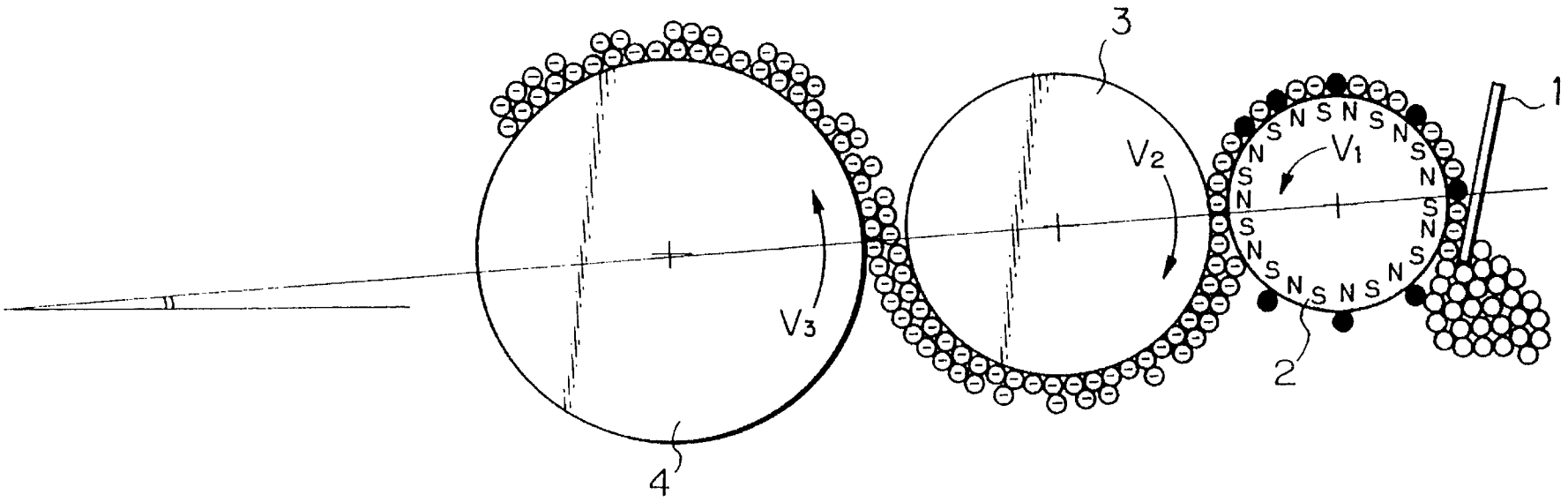
FIG. 4 is a fragmentary view of the developing device shown in FIG. 3.
Figure 5:
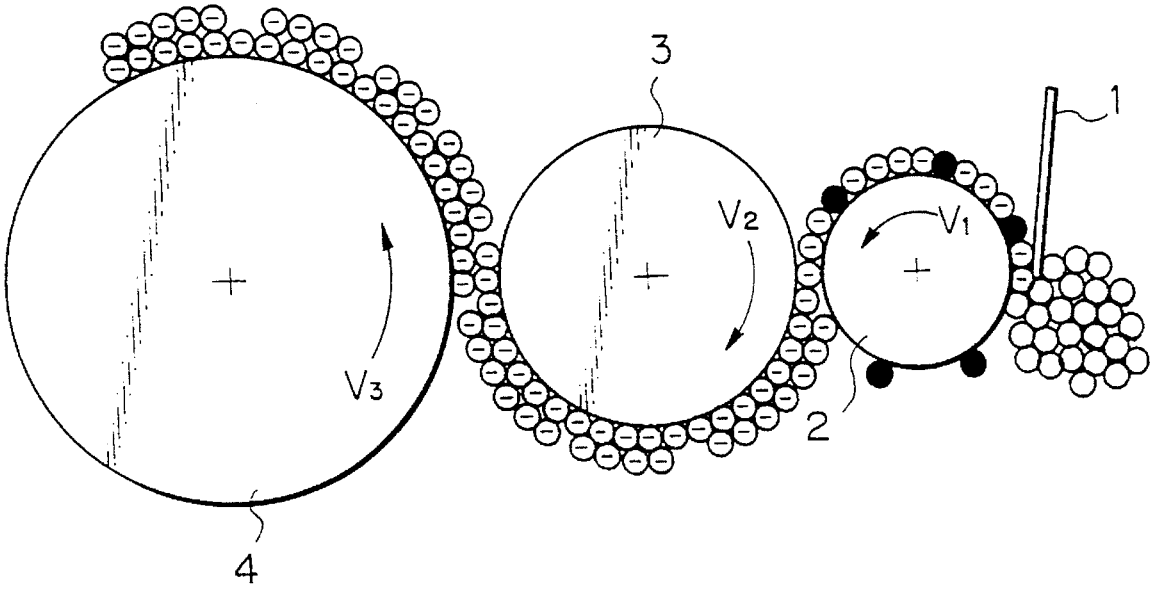
FIG. 5 is a fragmentary view of the developing device shown in FIG. 1.

The embodiment capable of solving the above problem will be described with reference to FIGS. 4 and 5. In FIGS. 4 and 5, the same or similar constituent parts as the parts shown in FIGS. 1–3 are designated by the same reference numerals. As shown in FIG. 4 or FIG. 5, assume that the first and second conveying means 2 and 3 are driven in the same direction, as seen at a position where they face each other. Then, if the first conveying means 2 is driven at a linear velocity $V_1$ higher than the linear velocity $V_2$ of the second conveying means 3 ($V_1/V_2 \geqq 1$), a greater amount of toner can be deposited on the conveying means 3 than on the conveying means 2 (for a unit area). Hence, assuming that the ratio of the linear velocity $V_2$ of the conveying means 3 to the liner velocity $V_3$ of the image carrier 4 is constant, the amount of toner to deposit on the image carrier 4 can be controlled on the basis of the above-mentioned ratio $V_1/V_2$. It follows that the ratio $V_2/V_3$ can be determined in matching relation to, among others, a required scavenging force and the frictional charging characteristic of the toner and image carrier 4.

To obviate defective images attributable to a difference in linear velocity between the second conveying means 3 and the image carrier 4 while insuring a required scavenging force, the ratio $V_2/V_3$ should preferably be about 1.1, as determined by experiments. Hence, the amount of toner on the image carrier 4 which is necessary for sufficient image density is about 1 mg/cm$^2$. On the other hand, the amount of toner on the first conveying means 2 which is suitable for uniform charging is about 0.3 mg/cm$^2$, since extremely small amounts of toner would cause the toner to break up or cause it to adhere to the regulating member 1. It follows that if the ratio $V_1/V_2$ is greater than or equal to 2 and smaller than or equal to 7, not only the background of the image carrier 4 is protected from contamination attributable to the oppositely charged particles, but also the ratio $V_2/V_3$ can have an adequate value. As a result, an image not only free from background contamination but also higher in quality is achievable.

Experimental results relating to the illustrative embodiment are as follows. Magnetic toner (FIG. 4) was charged more uniformly when the amount thereof on the first conveying means 2 was 0.2 mg/cm$^2$ to 0.5 mg/cm$^2$ in terms of the amount of magnetic substance. Regarding nonmagnetic toner (FIG. 5), the amount for more uniform charging was determined to range from 0.15 mg/cm$^2$ to 0.4 mg/cm$_2$. The ratio $V_2/V_3$ implemented both the scavenging force due to the difference in linear velocity between the second conveying means 3 and the image carrier 4 and the adequate frictional charging of toner lay in the range of $1.0<V2/V3 \leqq 1.3$. The amount of toner on the image carrier 4 which was necessary for sufficient image density was greater than 0.8 mg/cm$^2$ to 1.2 mg/cm$^2$ for magnetic toner (FIG. 4) or greater than 1.2 mg/cm$^2$ to 1.8 mg/cm$^2$ for nonmagnetic toner (FIG. 5) in terms of the amount of magnetic substance. Based on the combination of the above conditions, it was found that $2 \leqq V_1/V_2 \leqq 7$ further enhances the effects achievable with the embodiment.

Figure 6:
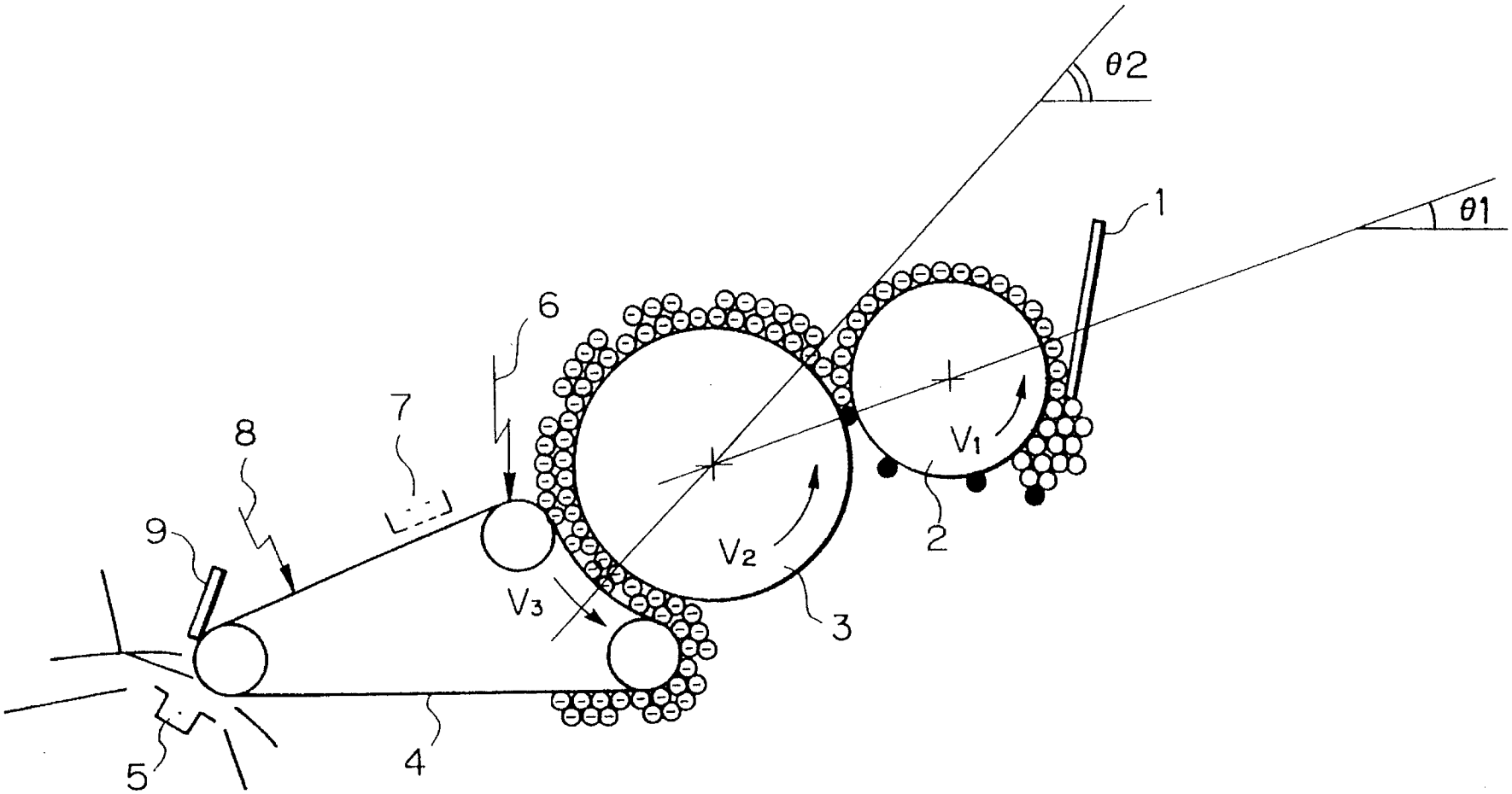
FIG. 6 schematically shows an alternative embodiment of the present invention using nonmagnetic toner.
Figure 7:
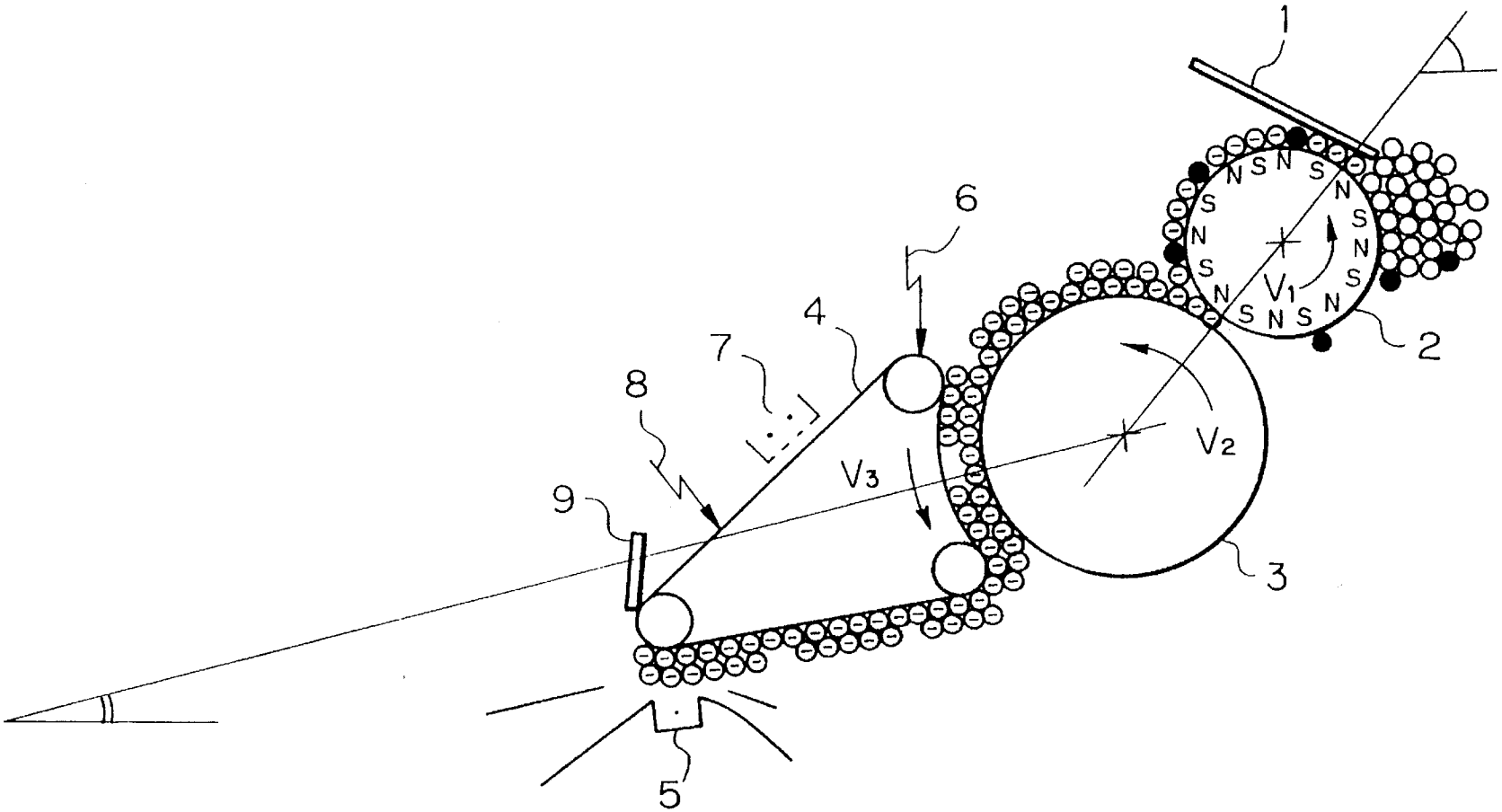
FIG. 7 schematically shows the alternative embodiment using magnetic toner in place of the nonmangnetic toner.

Referring to FIGS. 6 and 7, an image forming apparatus incorporating an alternative embodiment of the present invention is shown. In this embodiment, the same or similar constituent parts as or to the parts of the previous embodiment are designated by the same reference numerals. As shown, assume that the first and second conveying means 2 and 3 are drive in opposite directions to each other, as seen in the position where they face each other. Then, if the linear velocity $V_1$ of the first conveying means 2 is higher than the linear velocity $V_2$ of the second conveying means 3, i.e., $V_1/V_2 \leqq -1$, a greater amount of toner can be deposited on the conveying means 3 than on the conveying means 2 (for a unit area). Hence, assuming that the ratio $V_2/V_3$ is constant, the amount of toner to deposit on the image carrier 4 can be controlled on the basis of the ratio $V_1/V_2$. It follows that the ratio $V_2/V_3$ can be determined in matching relation to, among others, a required scavenging force and the frictional charging characteristic of the toner and image carrier 4.

To obviate defective images attributable to a difference in linear velocity between the second conveying means 3 and the image carrier 4 while insuring a required scavenging force, the ratio $V_2/V_3$ should preferably be about 1.1, as determined by experiments. Hence, the amount of toner on the image carrier 4 which is necessary for sufficient image density is about 1 mg/cm$^2$. On the other hand, the amount of toner on the first conveying means 2 which is suitable for uniform charging is about 0.3 mg/cm$^2$, since extremely small amounts of toner would cause the toner to break up or cause it to adhere to the regulating member 1. It follows that if the ratio $V_1/V_2$ is greater than or equal to −7 and smaller than or equal to −2, not only the background of the image carrier 4 is protected from contamination attributable to the oppositely charged particles, but also the ratio $V_2/V_3$ can have an adequate value. As a result, an image not only free from background contamination but also higher in quality is achievable.

In FIG. 6, θ1 and θ2 respectively represent an angle between a line passing through the axes of the conveying means 2 and 3 and the horizontal and an angle between a line passing through the centers of the conveying means 3 and image carrier 4 and the horizontal.

Experimental results relating to this embodiment are as follows. Magnetic toner (FIG. 7) was charged more uniformly when the amount thereof on the first conveying means 2 was 0.2 mg/cm$^2$ to 0.5 mg/cm$^2$ in terms of the amount of magnetic substance. Regarding nonmagnetic toner (FIG. 6), the amount for more uniform charging was determined to range from 0.15 mg/cm$^2$ to 0.4 mg/cm$^2$. The ratio $V_2/V_3$ implemented both the scavenging force due to the difference in linear velocity between the second conveying means 3 and the image carrier 4 and the adequate frictional charging of toner lay in the range of $1.0<V_2/V_3 \leqq 1.3$. The amount of toner on the image carrier 4 which was necessary for sufficient image density was greater than 0.8 mg/cm$^2$ to 1.2 mg/cm$^2$ for magnetic toner (FIG. 7) or greater than 1.2 mg/cm$^2$ to 1.8 mg/cm$^2$ for non magnetic toner (FIG. 6) in terms of the amount of magnetic substance. Based on the combination of the above conditions, it was found that $-7 \leqq V_1/V_2 \leqq -2$ enhances the effects achievable with the embodiment.

In summary, it will be seen that the present invention provides a developing device having various unprecedented advantages, as enumerated below.

(1) Toner is deposited on first conveying means while having the amount thereof regulated by a regulating member, transferred from the first conveying means to second conveying means, and then conveyed by the second conveying means to an image carrier for development. Hence, the device protects the background of the image carrier from contamination due to toner particles charged to the opposite polarity.

(2) The first and second conveying means are respectively driven at linear velocities $V_1$ and $V_2$ having a relation of $V_1/V_2 \geqq 1$. Hence, a greater amount of toner can be deposited on the second conveying means than on the first conveying means (for a unit area). This allows the ratio of the linear velocity of the second conveying means to that of the image carrier to be reduced, compared to a device of the type transferring toner directly from the first conveying means to the image carrier. Hence, in the case of contact development which is apt to suffer from an excessive scavenging force, there can be reduced an occurrence that the toner is charged in an unusual way in frictional contact with the image carrier, as well as other undesirable occurrences.

(3) The ratio $V_1/V_2$ lies in a range of $2 \leqq V_1/V_2 \leqq 7$, so that the second conveying means and image carrier can be provided with an adequate linear velocity ratio. This not only frees the background of the image carrier from contamination due to oppositely charged toner particles, but also insures more attractive images.

(4) The linear velocities $V_1$ and $V_2$ are held in a relation of $V_1/V_2 \leqq -1$. Hence, a greater amount of toner can be deposited on the second conveying means than on the first conveying means (for a unit area). This allows the ratio of the linear velocity of the second conveying means to that of the image carrier to be reduced, compared to a device of the type transferring toner directly from the first conveying means to the image carrier. Hence, in the case of contact development which is apt to suffer from an excessive scavenging force, there can be reduced an occurrence that the toner is charged in an unusual way in frictional contact with the image carrier, as well as other undesirable occurrences.

(5) The ratio $V_1/V_2$ lies in a range of $-7 \leqq V_1/V_2 \leqq -2$, so that the second conveying means and image carrier can be provided with an adequate linear velocity ratio. This not only frees the background of the image carrier from contamination due to oppositely charged toner particles, but also insures more attractive images.

Various modifications will become possible for those skilled in the art after receiving the teachings of the present disclosure without departing from the scope thereof.

What is claimed is:

1. A developing device for an image forming apparatus and for developing an electrostatic latent image formed on an image carrier by using single-component type toner, said device comprising:

regulating means for regulating an amount of toner and for charging toner by friction;

first conveying means for conveying the toner regulated and charged by said regulating means and deposited thereon; and second conveying means for conveying the toner transferred from said first conveying means thereto to the image carrier, and wherein toner is transferred from said first conveying means to said second conveying means by the force of an electric field;

said first conveying means and said second conveying means moving with respect to each other such that toner is carried on said second conveying means at a density higher than the density of toner carried on said first conveying means.

2. A device as claimed in claim 1, wherein said second conveying means moves at a linear velocity $V_2$ at a location at which said second conveying means faces the image carrier, and wherein the image carrier moves at a linear velocity $V_3$ at said location, and wherein $1.0 < V_2/V_3 \leqq 1.3$.

3. A device as claimed in claim 2, wherein said first conveying means is driven at a linear velocity $V_1$, and wherein $V_1/V_2 \geqq 1$.

4. A device as claimed in claim 2, wherein said first conveying means moves at a linear velocity $V_1$, and wherein $V_1/V_2 \leqq -1$.

5. A device as claimed in claim 1, wherein said first conveying means moves at a linear velocity $V_1$ and said second conveying means moves at a velocity $V_2$, and wherein $V_1/V_2 \geqq 1$.

6. A device as claimed in claim 1, wherein said first conveying means moves at a linear velocity $V_1$ and said second conveying means moves at a velocity $V_2$, and wherein $V_1/V_2 \leqq -1$.

7. A device as claimed in claim 1, wherein said first conveying means conveys toner including one of: (1) a magnetic toner disposed on said first conveying means at a density of 0.2 mg/cm$^2$ to 0.5 mg/cm$^2$, and (2) a nonmagnetic toner disposed on said first conveying means at a density of 0.15 mg/cm$^2$ to 0.4 mg/cm$^2$.

8. A developing device as claimed in claim 1, further including a toner supply container, and wherein said regulating means regulates toner supplied from said toner supply container to said first conveying means, and further wherein said first conveying means is disposed outside of said toner supply container.

9. A developing device as claimed in claim 8, wherein said toner supply container contains a magnetic toner, and wherein said first conveying means conveys said magnetic toner with a toner density of 0.2 mg/cm$^2$ to 0.5 mg/cm$^2$ on said first conveying means.

10. A developing device as claimed in claim 8, wherein said toner supply container contains a nonmagnetic toner, and wherein said first conveying means conveys said nonmagnetic toner with a toner density of 0.15 mg/cm$^2$ to 0.4 mg/cm$^2$ on said first conveying means.

11. A developing device as recited in claim 1, wherein said first conveying means conveys a magnetic toner with a toner density of 0.2 mg/cm$^2$ to 0.5 mg/cm$^2$ on said first conveying means.

12. A developing device as recited in claim 1, wherein said first conveying means conveys a nonmagnetic toner with a toner density of 0.15 mg/cm$^2$ to 0.4 mg/cm$^2$ on said first conveying means.

13. A developing device as claimed in claim 1, wherein said first conveying means moves at a linear velocity V1, said second conveying means moves at a linear velocity V2 at a location at which said second conveying means faces the image carrier, and said image carrier moves at a linear velocity V3, wherein V1>V2>V3.

14. A developing device as claimed in claim 1, wherein said first conveying means is in contact with said second conveying means.

15. A developing device as claimed in claim 14, wherein an electric field is developed between said first and second conveying means whereby the toner is transferred from said first conveying means to said second conveying means.

16. A developing device for an image forming apparatus and for developing an electrostatic latent image formed on an image carrier by using single-component type toner, said device comprising:

a toner supply container containing a supply of toner;

regulating means for regulating an amount of toner supplied by said toner supply container;

first conveying means disposed outside of said toner supply container for conveying the toner regulated by said regulating means and deposited thereon; and second conveying means for conveying the toner transferred from said first conveying means thereto to the image carrier;

wherein said first conveying means and said second conveying means respectively comprise rollers which are movable in a same direction at a position where said rollers face each other, said first conveying means and said second conveying means being respectively movable at linear velocities $V_1$ and $V_2$ having a relation of $V_1/V_2 \geqq 1$.

17. A device as claimed in claim 16, wherein a ratio $V_1/V_2$ lies in a range of $2 \leqq V_1/V_2 \leqq 7$.

18. A developing device as claimed in claim 16, wherein said toner supply container contains a magnetic toner, and wherein said first conveying means conveys said magnetic toner with a toner density of 0.2 mg/cm$^2$ to 0.5 mg/cm$^2$ on said first conveying means.

19. A developing device as claimed in claim 16, wherein said toner supply container contains a nonmagnetic toner, and wherein said first conveying means conveys said nonmagnetic toner with a toner density of 0.15 mg/cm$^2$ to 0.4 mg/cm$^2$ on said first conveying means.

20. A developing device as claimed in claim 16, wherein said image carrier moves at a linear velocity V3, wherein V1>V2>V3.

21. A developing device as claimed in claim 16, wherein said first conveying means is in contact with said second conveying means.

22. A developing device as claimed in claim 21, wherein an electric field is developed between said first and second conveying means whereby the toner is transferred from said first conveying means to said second conveying means.

23. A developing device for an image forming apparatus and for developing an electrostatic latent image formed on an image carrier by using single-component type toner, said device comprising:

a toner supply container containing a supply of toner;

regulating means for regulating an amount of toner supplied by said toner supply container;

first conveying means disposed outside of said toner supply container for conveying the toner regulated by said regulating means and deposited thereon; and second conveying means for conveying the toner transferred from said first conveying means thereto to the image carrier;

wherein said first conveying means and said second conveying means respectively comprise rollers which are movable in opposite directions to each other at a position where said rollers face each other, said first conveying means and said second conveying means being respectively movable at linear velocities $V_l$ and $V_2$ having a relation of $V_1/V_2 \leqq 1$.

24. A device as claimed in claim 23, wherein a ratio $V_1/V_2$ lies in a range of $-7 \leqq V_1/V_2 \leqq -2$.

25. A developing device as claimed in claim 23, wherein said toner supply container contains a magnetic toner, and wherein said first conveying means conveys said magnetic toner with a toner density of 0.2 mg/cm$^2$ to 0.5 mg/cm$^2$ on said first conveying means.

26. A developing device as claimed in claim 23, wherein said toner supply container contains a nonmagnetic toner, and wherein said first conveying means conveys said nonmagnetic toner with a toner density of 0.15 mg/cm$^2$ to 0.4 mg/cm$^2$ on said first conveying means.

27. A developing device as claimed in claim 23, wherein said image carrier moves at a linear velocity V3, wherein V1>V2>V3.

28. A developing device as claimed in claim 23, wherein said first conveying means is in contact with said second conveying means.

29. A developing device as claimed in claim 28, wherein an electric field is developed between said first and second conveying means whereby the toner is transferred from said first conveying means to said second conveying means.

30. An image forming apparatus comprising:

an image carrier;

regulating means for regulating an amount of toner;

first conveying means for conveying the toner regulated by said regulating means and deposited on said first conveying means at a first density, said first conveying means moving at a linear velocity $V_1$; and second conveying means for conveying the toner transferred from said first conveying means thereto to the image carrier, said second conveying means carrying toner deposited thereon at a second density, and wherein said second density is higher than said first density, said second conveying means moving at a linear velocity $V_2$;

wherein said image carrier moves at a linear velocity $V_3$, and wherein $1.0 < V_2/V_3 \leqq 1.3$.

31. The apparatus of claim 30, wherein $V_1/V_2 \geqq 1$.

32. The apparatus of claim 30, wherein $V_1/V_2 \leqq -1$.

33. The apparatus of claim 30, wherein said toner is a magnetic toner and said first density is 0.2 mg/cm$^2$ to 0.5 mg/cm$^2$.

34. The apparatus of claim 30, wherein said toner is a nonmagnetic toner and said first density is 0.15 mg/cm$^2$ to 0.4 mg/cm$^2$.

35. The apparatus of claim 30, wherein $2 \leqq |V_1/V_2| \leqq 7$.

* * * * *